US011668061B2

(12) United States Patent
Baßfeld et al.

(10) Patent No.: US 11,668,061 B2
(45) Date of Patent: Jun. 6, 2023

(54) MODULAR SYSTEM FOR WEED CONTROL

(71) Applicant: Bayer Aktiengesellschaft, Leverkusen (DE)

(72) Inventors: Hinnerk Baßfeld, Lienen (DE); Thomas Arians, Rommerskirchen (DE); Nils Keilholz, Werdohl (DE)

(73) Assignee: DISCOVERY PURCHASER CORPORATION, Wilmington, DE (US)

( * ) Notice: Subject to any disclaimer, the term of this patent is extended or adjusted under 35 U.S.C. 154(b) by 775 days.

(21) Appl. No.: 16/607,498

(22) PCT Filed: Apr. 23, 2018

(86) PCT No.: PCT/EP2018/060293
§ 371 (c)(1),
(2) Date: Oct. 23, 2019

(87) PCT Pub. No.: WO2018/197388
PCT Pub. Date: Nov. 1, 2018

(65) Prior Publication Data

US 2020/0139393 A1 May 7, 2020

(30) Foreign Application Priority Data

Apr. 28, 2017 (EP) ..... 17168844
May 23, 2017 (EP) ..... 17172539

(51) Int. Cl.
*E01H 11/00* (2006.01)
*B05B 1/16* (2006.01)
(Continued)

(52) U.S. Cl.
CPC ..... *E01H 11/00* (2013.01); *B05B 1/16* (2013.01); *B05B 1/169* (2013.01); *B05B 1/20* (2013.01);
(Continued)

(58) Field of Classification Search
CPC ..... E01H 11/00; B05B 1/16; B05B 1/169; B05B 1/20; B05B 7/0408; B05B 12/004;
(Continued)

(56) References Cited

U.S. PATENT DOCUMENTS 3,101,902 A * 8/1963 Chamberlain ..... A01M 7/0003 239/545
5,381,958 A * 1/1995 Koblmuller ..... E01H 11/00 239/174
(Continued)

FOREIGN PATENT DOCUMENTS

DE 4132637 A1 4/1993
EP 1695620 A1 * 8/2006 ..... A01M 21/04
(Continued)

OTHER PUBLICATIONS

Japanese Notification of Reason for Rejection dated Jan. 28, 2022 for Japanese Patent Application No. 2019-558378 with English translation (6 pages).

*Primary Examiner* — Darren W Gorman
(74) *Attorney, Agent, or Firm* — McBee Moore & Vanik IP, LLC

(57) ABSTRACT

The invention relates to a modular system for weed control for a rail vehicle. The modular system has a control module including a control unit and a control module. The control unit is configured to generate a first set of control signals for controlling valves and mixers in an herbicide and mixing module configured to mix an herbicide mixture and to generate a second set of control signals for controlling valves of a nozzle assembly. The herbicide and mixing module has a plurality of containers for receiving different herbicides. The nozzle assembly has a first set of nozzles for spraying herbicides, and the control module, the herbicide
(Continued)

and mixing module, and the nozzle assembly can each be individually fixed to a carrier element in a reversible manner.

19 Claims, 8 Drawing Sheets

(51) Int. Cl.

| | |
|---|---|
| ***B05B 1/20*** | (2006.01) |
| ***B05B 12/02*** | (2006.01) |
| ***B05B 12/16*** | (2018.01) |
| ***B05B 7/04*** | (2006.01) |
| ***B05B 12/00*** | (2018.01) |
| ***B05B 12/12*** | (2006.01) |
| ***B05B 13/00*** | (2006.01) |
| ***B61D 15/00*** | (2006.01) |

(52) U.S. Cl.
CPC ..... *B05B 7/0408* (2013.01); *B05B 12/004* (2013.01); *B05B 12/02* (2013.01); *B05B 12/122* (2013.01); *B05B 12/124* (2013.01); *B05B 12/16* (2018.02); *B05B 13/005* (2013.01); *B61D 15/00* (2013.01)

(58) Field of Classification Search
CPC ..... B05B 12/02; B05B 12/122; B05B 12/124; B05B 12/16; B05B 13/005; B61D 15/00; A01M 7/005; A01M 7/0053; A01M 7/006; A01M 7/0071; A01M 7/0089; A01M 21/04; A01M 21/043
See application file for complete search history.

(56) References Cited

U.S. PATENT DOCUMENTS

| | | | |
|---|---|---|---|
| 5,465,874 | A | 11/1995 | Roach et al. |
| 6,065,686 | A | 5/2000 | Betts-Williams et al. |
| 2008/0094935 | A1 | 4/2008 | Newton et al. |

FOREIGN PATENT DOCUMENTS

| | | | | | |
|---|---|---|---|---|---|
| EP | 2728068 | A1 | | 10/2013 | |
| EP | 2728068 | A1 | | 5/2014 | |
| GB | 1404342 | A | | 8/1975 | |
| GB | 2327231 | A | * | 1/1999 | ..... A01M 21/043 |
| JP | H09504953 | A | | 5/1997 | |
| JP | 2010-507393 | A | | 3/2010 | |
| NL | 8800868 | A | | 11/1989 | |
| WO | 9803733 | A1 | | 1/1998 | |
| WO | WO2004005625 | A1 | | 1/2004 | |

* cited by examiner

MODULAR SYSTEM FOR WEED CONTROL

CROSS REFERENCE TO RELATED APPLICATIONS

This application is a national stage application under 35 U.S.C. § 371 of International Application No. PCT/EP2018/060293, filed internationally on Apr. 23, 2018, which claims the benefit of priority to European Application Nos. 17168844.3, filed Apr. 28, 2017, and 17172539.3, filed May 23, 2017.

FIELD OF THE DISCLOSURE

The invention relates to a modular system for weed control for a rail vehicle, a spraying train, and a method for controlling weeds in a track bed.

BACKGROUND OF THE DISCLOSURE

A known task which operators of rail systems are continuously faced with is keeping the train tracks free of undesired vegetation, in particular weeds. In this case, a differentiation is known to be made between preventative measures for weed control and measures which are initiated when the weed has already grown. Rail-bound systems are known, which use a technology based on a camera system to control weeds in a targeted manner; however, the known rail vehicles which are equipped with corresponding devices for weed control are relatively inflexible. A use of these known rail vehicles for weed control generally requires long and slow travel times due to frequently slow travel speeds to the usage locations. In particular in the case of frequently changing usage locations, this is a significant disadvantage, in particular if the usage locations are far apart from one another. This results in a poor usage/transportation ratio and thus unnecessary engagement of capital, since generally a plurality of these rail vehicles has to be kept ready for weed control at different locations. This is also accompanied by a greater maintenance expenditure and a greater demand for personnel. In addition, the known rail vehicles for weed control have a fixed track gauge, so that they are only usable on rails of this predetermined track gauge.

SUMMARY OF THE DISCLOSURE

The present invention is therefore based on the object of proposing a concept for a rail vehicle for weed control—and/or a spraying train—which makes the spraying train independent of a given rail system.

The above-mentioned object is achieved by the subjects of the independent claims. Advantageous embodiments of the invention result from the dependent claims, the following description, and the figures.

According to a first aspect of the present invention, a modular system for weed control for a rail vehicle is proposed. The modular system can comprise an array of modules: a support and control module, which comprises a control unit configured for generating a first set of control signals for controlling valves and mixers in a separate herbicide and mixing module for mixing a herbicide mixture, and configured for generating a second set of control signals for controlling valves of a nozzle assembly. Furthermore, the support and control module comprises a control station for manual checking and monitoring of the control unit, the herbicide and mixing module, and the nozzle assembly.

The herbicide and mixing module is to be mentioned as a further module. It comprises a plurality of containers for accommodating different herbicides, which have a selective fluidic connection to the valves and mixers. The herbicide and mixing module furthermore comprises a water fitting, which can selectively have a selective fluidic connection to the valves and mixers. Moreover, terminal elements can be provided, via which electrical signal connections can be established to terminal elements of the control unit, so that the first control signals generated in the support and control module can be conducted to the valves and mixers of the herbicide and mixing module.

In addition, the modular system comprises a nozzle assembly, which can be spatially independent of each of both the support and control module and the herbicide and mixing module. The nozzle assembly can comprise a first set of nozzles for spraying herbicides and a fluid connection to selected valves and mixers of the herbicide and mixing module.

The support and control module, the herbicide and mixing module, and the nozzle assembly can each be individually reversibly fixable on a carrier element.

According to a second aspect of the present invention, a spraying train for weed control on railways is proposed. The spraying train comprises the above-mentioned modular system for weed control, which can be transported on one or more carrier cars, and also a tank car for accommodating water, and a freight car.

According to a third aspect of the present invention, a method for controlling weeds in a track bed is proposed. The method comprises a series of steps: reversibly fixing a support and control module on a carrier element, reversibly fixing a herbicide and mixing module on the carrier element, and reversibly fixing a nozzle assembly on the carrier element, wherein the nozzle assembly can be spatially independent of each of both the support and control module and the herbicide and mixing module. In addition, the method comprises establishing a fluidic connection between the herbicide and mixing module and the nozzle assembly, generating a first set of control signals for controlling valves and mixers in the herbicide and mixing module for mixing a herbicide mixture by means of a control unit of the support and control module, and generating a second set of control signals for controlling valves of a nozzle assembly by means of the control unit of the support and control module, and selectively spraying the herbicide mixture via nozzles of the nozzle assembly onto railways.

The herbicide and mixing module comprises an array of features: a plurality of containers for accommodating different herbicides, which can selectively have a selective fluidic connection to the valves and mixers, a water fitting, which can selectively have a selective fluid connection to the valves and mixtures, and terminal elements, via which electrical signal connections can be established to terminal elements of the control unit, so that the first control signals generated in the support and control module can be conducted to the valves and mixers of the herbicide and mixing module.

DETAILED DESCRIPTION

Figure 1:
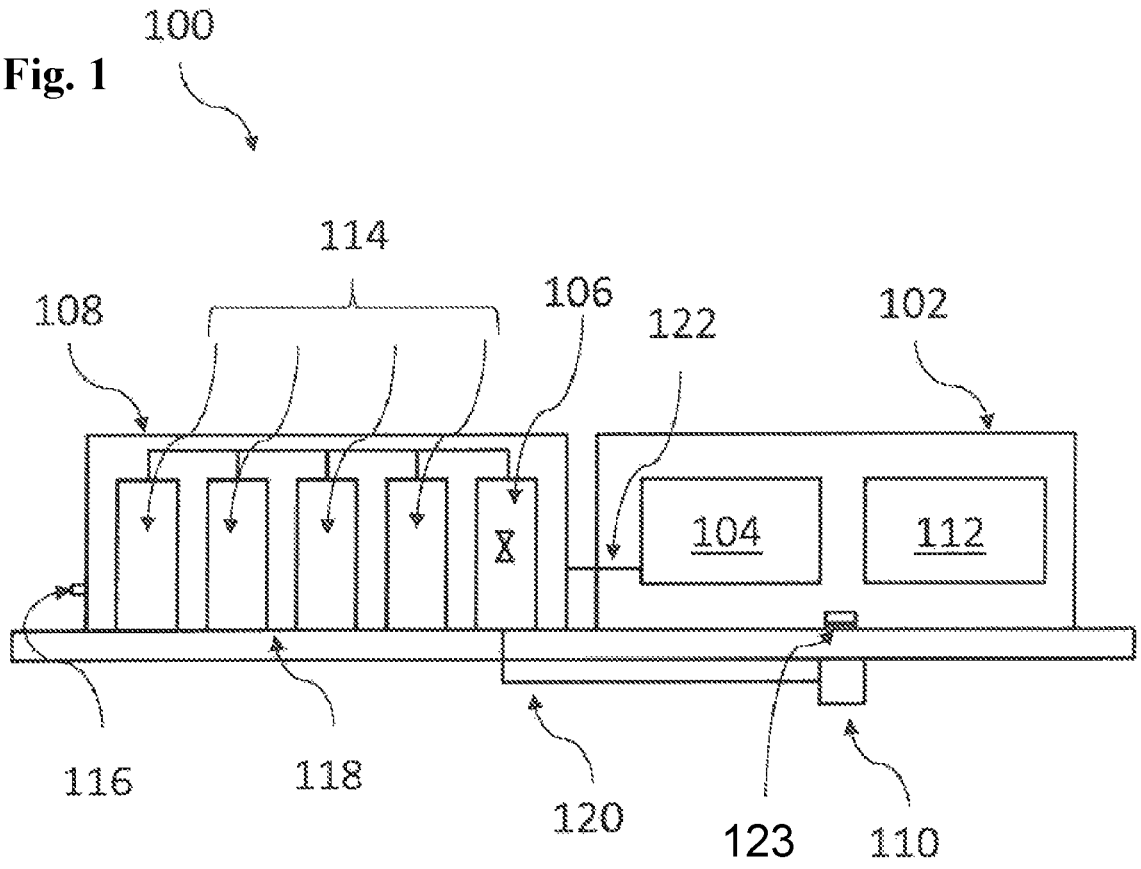
FIG. 1 shows the modular system for weed control for a rail vehicle, according to some embodiments.

The invention will be explained in greater detail hereafter without differentiating between the subjects of the invention (system, spraying train, method). The following explanations are rather to apply similarly to all subjects of the invention, independently of the context in which they are provided.

If steps are listed in a sequence during the description of the method according to the invention, this thus does not necessarily mean that the steps also have to be executed in the specified sequence. Rather, the invention is to be understood to mean that the steps executed in one sequence can be executed in any arbitrary sequence or also in parallel with one another, unless one step is based on another step, which is clear from the description of the respective steps. The specific sequences listed in this document accordingly only represent preferred embodiments of the invention.

The following terms, expressions, and definitions are used in this document:

The term "modular system" describes in the context of the proposed spraying train that various modules are provided, from which a weed control for track beds may be assembled. The individual modules—in particular in the case of a transportation—are independent of one another in this case. They may be assembled at a destination—i.e., at the usage location for weed control—to form a functional overall system for weed control on railways.

The term "weed control" describes the procedure of discharging herbicides to intentionally control existing weeds. In addition, proactive measures are also to be understood as weed control in the context of this description; i.e., those measures which prevent weeds from occurring from the outset.

The term "rail vehicle" describes a wagon and/or a railcar for rail traffic. A rail vehicle generally comprises at least two axles each having two wheels, which can be placed on two rails extending parallel to one another. The two axles are generally connected to a chassis, on which corresponding structures (for example, for accommodating goods or persons to be transported) can be placed.

The term "support and control module" is a module independent per se, which functions as a central control module of the proposed modular system for weed control for a rail vehicle. Essentially all control signals are generated and/or processed in the support and control module to ensure the overall function of the modular system for weed control for a rail vehicle. In addition, manual interventions are also possible by way of the support and control module via a control station.

The term "control signal" describes an electrical signal which is generated by a controller and controls an activator—for example, in the form of a valve or a nozzle—in its functionality.

The term "herbicide and mixing module" describes a further module of the modular system for weed control for a rail vehicle. The herbicide and mixing module comprises a plurality of containers, which can accommodate different herbicides. In addition, a plurality of valves is provided, so that different herbicide mixtures, preferably weed-specific herbicide mixtures, are producible on location. The herbicide and mixing module furthermore comprises various fittings: a water fitting and a plurality of electrical lines for the control and checking of the function of the herbicide and mixing module. In addition, additional lines can be provided to refill one or more of the containers with corresponding herbicides. Furthermore, at least one fitting is provided for a supply line to at least one nozzle assembly.

The term "nozzle assembly" describes a carrier framework, on which at least one nozzle, preferably a plurality of nozzles is provided for discharging the herbicide mixtures. The nozzle assembly is a further module of the modular system for weed control for a rail vehicle. The nozzle assembly also typically has a plurality of electrical terminals, via which the function of the individual nozzles is controlled. In addition, the nozzle assembly comprises one or more fittings for supply lines of the herbicide mixtures and/or water and/or compressed air.

The term "selective fluidic connection" describes a connection between a source and a drain for a gas or a liquid. The selectivity of the fluid connection indicates that the intensity of the connection—i.e., the cross section of the connection and/or the flow speed and thus the material quantity transported through the fluid connection—can be selectively influenced. This controlling influencing typically takes place via one or more valves.

The term "carrier element" describes a shared base for the modules of the modular system for weed control for a rail vehicle. In this case, all modules do not have to be installed on—i.e., above—the carrier element. They can also be reversibly connectable to the carrier element laterally thereon or below it.

The term "in container construction" has a direct relationship to the modular construction of the modular system proposed here. All or some of the modules of the modular system can each be integrated into a standard container—for example, a standard 20-foot container. Standard containers are preferably understood as the containers which are described in ISO standard 668:2013-08. Of course, other container sizes are also possible. The term "container construction" is also to comprise modules which may be integrated into a standard container, for example, to be able to transport the module integrated in such a standard container using routine means (for example, truck, aircraft, or ship, which are configured for the transportation of standard containers). It is conceivable, for example, that one or more modules comprise a platform (baseplate), which has the same dimensions as the platform of a standard container, and side walls and a roof wall may be attached to the platform or the side walls, respectively, so that the module may be housed and the house module represents a standard container. The advantage of the container construction is, inter alia, that different modules can be accommodated in a respective container. This relates, for example, to the support and control module, the herbicide and mixing module, or also a residence or storage module.

A "camera module" comprises at least one electronic camera and an analysis electronics unit. The camera module generally has substantially smaller dimensions than the above-described container-size modules of the modular system for weed control. The camera module is connected to the support and control module via electrical connections for data exchange purposes. The camera module can comprise one or more cameras, which observe different portions of a track bed.

The term "weed signal" describes one or more electrical signals which indicate a presence of weeds/weeds by the characteristic thereof. Based on one of these weed signals, herbicides and/or herbicide mixtures can be provided for weed control.

The term "weed-specific signal" describes one or more electrical signals which indicate a presence of a specific weed species by the characteristic thereof. Based on one of these weed-specific signals, weed-specific herbicides and/or herbicide mixtures can be provided for the targeted control of the corresponding weed species.

The term "energy module" describes a further module of the modular system for weed control. The energy module can also be provided in container construction. Alternatively, a housing can protect, for example, a generator for power generation from external influences. This housing can be installed in addition to other elements on a platform, which again represents a base platform of a standard container.

The term "carrier car" in the context of the concept proposed here describes a freight car in the form of a flat car, which comprises a carrier frame but no further fixed structures. The axles are typically suspended on railroad trucks.

The term "residence module" describes a further optional module of the modular system for weed control. This module can also be embodied in container construction. Units can be provided therein which are suitable for a residence of persons—for example, for relaxation or work purposes.

The concept proposed here of the modular system for weed control for a rail vehicle has an array of advantages:

Due to the structure of the system for weed control in modular construction, the system for weed control can be transported easily from one usage location to another usage location. In this case, it can be transported independently of a rail transportation vehicle, for example, on the road (container truck), via ship, or via aircraft. Since it includes multiple modules independent of one another, which are connected as needed by means of hoses and electrical lines, the individual module has a comparatively small dimension in comparison to conventional systems consisting of complete rail vehicles for weed control of track beds. For example, each module can be implemented in the form of a 20-foot standard container. Corresponding carrier cars can comprise standard fastening devices for such standard containers. Practically no special devices are required on the respective carrier cars at the different usage locations. A transportation on the rail at comparatively lower travel speed is therefore not required. This proves to be particularly advantageous if the usage locations of the system for weed control for a rail vehicle change frequently. Overall, a business which performs weed control on track beds requires a smaller number of such weed control systems. This reduces the required capital and maintenance expenditure.

In addition, it is not necessary to set up a maintenance station at every usage location. It is also not necessary to transport the modular system for weed control for a rail vehicle over long rail distances to a central maintenance facility. Alternative road and air transports are possible for this purpose.

Moreover, the modules of the system for weed control may also be installed without problems on carrier cars of different track gauges. The system for weed control is thus independent of the respective undercarriage, as long as it is suitable for accommodating the standardized modules.

In addition, the modular system for weed control is also not directed to one type of carrier car. Rather, the modules can either be installed on a common carrier car or distributed onto multiple smaller carrier cars. Only cable and/or hose connections are required from one carrier car to the next. These can be flexible and can connect the modules to one another if needed.

It is to be noted that the embodiments of the invention were described with reference to different subjects of the invention. In particular, some embodiments of the invention can be described using device claims and other embodiments of the invention can be described using method claims. However, it will be immediately clear to a person skilled in the art upon reading the present description that, if not explicitly indicated otherwise, in addition to a combination of features which are associated with one type of subject matter of the invention, any arbitrary combination of features is possible which is associated with different categories of subjects of the invention.

Further advantages and features of the present invention result from the following exemplary description of presently preferred embodiments. The individual figures of the drawings of this application are to be considered to be solely schematic, exemplary, and not to scale.

According to one advantageous exemplary embodiment of the modular system, the support and control module and the herbicide and mixing module can be embodied in container construction. This can be a standardized industry container in this case, for example, an ISO container (ISO 668:2013-08, freight container; TEU=Twenty-Foot Equivalent Unit) in a size of 20 feet each. These have the advantage that they provide a standardized housing for different parts of the modular system, on which standardized fastening points are also provided, using which the container can be fastened on platforms or carrier cars. Moreover, they can be transported without problems independently of one another from one usage location to another usage location—also over national borders or from continent to continent.

According to one special exemplary embodiment of the modular system, a camera module can be provided, which can generate a weed signal or a weed-specific signal, respectively, in reaction to a detection of weed/weeds and/or a specific weed species. In this manner, the detected weeds—or also individual weed species upon detection of defined weed species—can be intentionally controlled. The camera module can be configured so that it detects a specific type of a weed and the weed-specific signal can intentionally influence a herbicide mixture suitable for controlling the detected weed type, which is sprayed by the herbicide and mixing module via the nozzle assembly. In this manner, the corresponding herbicide is only used where it is required. This can save costs and can stress the environment with lower quantities of herbicides. It is conceivable that multiple camera modules are provided, which observe different portions of the track bed.

Accordingly, in a refined exemplary embodiment of the modular system, the control unit can also be configured to receive a weed signal and/or a weed-specific signal. The generation of the first set of signals and the generation of the second set of signals can be controllable by the received signal. Valve-controlling monitoring units can be configured for this purpose, in order to receive, interpret, and form the signal and to generate corresponding control signals for valves and mixers.

Alternatively, according to a further exemplary embodiment of the modular system, the generation of the first set of signals and the generation of the second set of signals can be able to be manually triggered. The signals of the camera module can thus be overwritten, so that the system still remains ready for use for weed control in the event of a failure of the camera module. In addition, the system for weed control can be operated completely without camera module. This applies accordingly for an interruption of the spraying of herbicides, for example, when traveling through populated regions, if people are located on the track bed, or other units potentially endangered by herbicides are affected.

Furthermore, according to a further exemplary embodiment of the modular system, the generation of the first set of signals and the generation of the second set of signals can alternatively be able to be triggered by means of a weed map and a position of the nozzle assembly determined by a received GPS signal. The weed map can be generated beforehand by a journey of a train having a camera module. Alternatively, the weed map can also be produced by means of a camera-carrying drone. For this purpose, the drone can fly along the course of the rails. Collisions with other trains or bottlenecks in timetables in the case of strongly traveled sections can thus be avoided, because a drone can simply dodge upward from a train without neglecting its weed map production task. The recordings of the camera(s) can moreover be synchronized with a GPS. An off-line analysis can associate individual GPS coordinates with detected weeds off-line. During a spraying trip using the modular system for weed control, the herbicides can then be sprayed in accordance with the respective GPS position of the nozzle assembly. This can also reduce the environmental strain and reduce the costs, since herbicides are only sprayed where it is necessary.

A supplementary exemplary embodiment of the modular system additionally comprises an energy module on a platform in modular construction and/or container construction. The energy module can be electrically connectable in each case to the support and control module and the herbicide mixing module. Moreover, the energy module—just like the support and control module and the herbicide and mixing module—can be reversibly fixable on the carrier element on a platform. The energy module can thus comprise a base platform corresponding to a standard container, which also comprises corresponding fastening points to be fastened on a carrier car, for example. The actual electrical power generating unit can consist of a combination of a gasoline/diesel engine and a generator. Both together can be installed in a shared housing. In addition, a residence platform can also be located on the platform of the energy module. Via this, the operating personnel can move from the support and control module to the herbicide and mixing module if the energy module having its corresponding platform is located between the support and control module and the herbicide and mixing module. At the same time, this residence platform can be used as a collecting point and/or escape route for the operating personnel. A ladder can make this residence platform easily reachable from the track bed.

An additional supplementary exemplary embodiment of the modular system can comprise a residence module in container construction having a passage to the support and control module. In this case, the residence module can also be reversibly fixable on the carrier element. In this manner, the modular system still remains flexibly usable for weed control. Individual components/modules of the system for weed control can each be individually transported and fastened on a carrier element.

According to one advantageous exemplary embodiment of the modular system, the carrier element can accordingly be a carrier car for rail usage. Such carrier cars are well known according to the prior art and are easily available at practically any usage location of the modular system for weed control. It is thus possible to use the modular system for weed control at practically any arbitrary location. A transportation of the carrier car from one usage location to another is not required.

According to a further exemplary embodiment of the modular system, the carrier car can be a standard 80-foot carrier car (which is compatible with 80-foot standard containers according to ISO 668:2013-08). It can typically comprise double axles on trucks at the ends of the carrier car. Alternative 80-foot carrier cars have single axles at the left end, in the middle, and at the right end of the carrier car. However, it has been shown that the carrier cars having double axles on trucks at the respective ends of the carrier car run quieter. This can be more advantageous for electronics or other equipment located on board (in the modules).

Alternatively, according to another exemplary embodiment of the modular system, the carrier car can consist of multiple carrier cars coupled to one another. In this case, the individual carrier cars can have the length of one of the modules of the modular system for weed control—for example, 20 feet. Alternatively, two modules can be installed on a longer—for example, 40-foot—carrier car. The overall system is thus completely flexible not only with respect to its modules but rather also with respect to the carrier cars to be used and can be adapted to the respective carrier cars present at the usage location. Therefore—according to one exemplary embodiment—at least one of the modules—i.e., the support and control module, the herbicide mixing module, the energy module, and/or the residence module—of the modular system can be provided in the size of a 20-foot container.

According to a further advantageous exemplary embodiment of the modular system, the first set of nozzles can be arranged below the carrier element, so that the first set of nozzles of the nozzle assembly is usable for weed control in a track bed. In this case, the term "in a track bed" can mean that this involves the space between the rails.

According to a supplementary exemplary embodiment of the modular system, the nozzle assembly can comprise a second set of nozzles on the nozzle assembly, one half of which can be arranged at each of the lateral ends of the nozzle assembly. Via these nozzles, the embankment of the track bed (i.e., the part of the track bed outside the rails) and potentially a path extending in parallel along the railway line can be treated using herbicides.

According to a further advantageous exemplary embodiment of the modular system, the control and mixing module can comprise a window inclined in the travel direction. Multiple windows inclined in relation to the travel direction are also conceivable. The angle of inclination is preferably from 1° to 45°, more preferably from 3° to 30°, most preferably from 5° to 25° in relation to the travel direction. In this case, a first vertical end of the window can end at one exterior outer side of the control and mixing module, and an opposing, second vertical end of the window can be offset in the direction of a middle of the control and mixing module in the longitudinal direction of the control and mixing module.

In this manner, it is possible for an operator inside the control and mixing module to look laterally and substantially in the travel direction out of the control and mixing module. In this manner, regions can be identified early by the operator which are not to be treated using herbicides (cultivated plants, for example, in allotment gardens, persons on paths extending in parallel, structures extending close to the track bed, bodies of water, for example, below a bridge when traveling over the bridge, etc.) and it is made possible in this manner for the operator to effectuate immediate shutdown of the herbicide supply to the nozzle assembly.

It is conceivable that the control and mixing module is embodied symmetrically, so that it is not relevant in which direction the spraying train moves—the personnel typically located in the control and mixing module can carry out their tasks independently of the direction in which the spraying train is moving, without the control and mixing module having to be adapted to the respective movement direction. Accordingly, the control and mixing module has windows in one preferred embodiment, which are inclined in both possible movement directions of the spraying train. The control and mixing module preferably comprises a cabin, in which the personnel are typically located, wherein the cabin at least partially has the shape of a hexagon viewed from above (top view), wherein the surfaces which extend parallel to the movement directions of the spraying train and the surfaces which are inclined in relation to the movement directions are equipped with windows.

If the spraying train travels in one direction (to the "front"), the personnel on the right and left can survey the regions on the right and left from the spraying train, which the spraying train will shortly reach, through the windows inclined in the travel direction. If the spraying train travels in the other, opposing direction (to the "rear"), windows are again located on the right and left sides of the cabin, through which the personnel can survey the regions on the right and left of the spraying train, which the spraying train will reach shortly.

According to a supplementary exemplary embodiment of the modular system, the control and mixing module can comprise a camera at the height of the nozzle assembly on its outer side. In this manner, direct observation of the spraying nozzles can be possible for the operating personnel. Multiple such cameras can also be used; for example, on the left and on the right sides of the control and mixing module or underneath. It is additionally possible to position further cameras directly on the nozzle assembly to enable still better monitoring of the function of the nozzle assembly in this manner.

According to a further advantageous exemplary embodiment of the modular system, the nozzle assembly can be fastened on the carrier element below the control and mixing module. A direct observation of the function of the nozzle assembly is thus possible and the GPS position of the control and mixing module also simultaneously corresponds to the GPS position of the nozzle assembly.

Preferred exemplary embodiments of the invention will be described hereafter on the basis of examples and with reference to FIGS. 1-8.

It is to be noted that the features and/or components of different embodiments, which are identical or at least functionally-equivalent to the corresponding features and/or components of the embodiment, are provided with identical reference signs or with a different reference sign which only differs in its first number from the reference sign of a (functionally) corresponding feature or a (functionally) corresponding component. To avoid unnecessary repetitions, features and/or components already explained on the basis of a previously described embodiment are not explained in detail again at a later point.

Furthermore, it is to be noted that the embodiments described hereafter merely represent a restricted selection of possible embodiment variants of the invention. In particular, it is possible to combine the features of individual embodiments with one another in a suitable manner, so that a plurality of different embodiments is considered to be obviously disclosed for a person skilled in the art by the embodiment variants explicitly described here.

FIG. 1 shows the modular system 100 for weed control for a rail vehicle (not shown) in a schematic illustration. The modular system 100 comprises a support and control module (SCM) 102. This module in turn comprises a control unit 104. It is configured to generate a first set of control signals (shown as the connection 122) for controlling valves and mixers 106 in a separate herbicide and mixing module (HMM) 108 for mixing a preferably weed-specific herbicide mixture and to generate a second set of control signals for controlling valves of a nozzle assembly 110.

In addition, the modular system 100 can comprise a control station 112 for manually checking and monitoring the control unit 104, the herbicide and mixing module 108, and the nozzle assembly 110.

The herbicide and mixing module 108 comprises a plurality of containers 114 for accommodating different herbicides, which have a selective fluidic connection selectively to the valves and mixers 106. In addition, the herbicide and mixing module 108 can comprise a water fitting 116, which has a selective fluidic connection selectively to the valves and mixers 106, and terminal elements, via which electrical signal connections can be established to terminal elements—for example, in the form of plugs on an outer wall of the respective module —of the control unit 104, so that the first control signals generated in the support and control module 102 can be relayed to the valves and mixers of the herbicide and mixing module. The optional water fitting 116 can be connected via a hose connection to a separate water car (not shown here).

In addition, the modular system 100 comprises the nozzle assembly 110, which is spatially independent of each of both the support and control module 102 and the herbicide and mixing module 108. This means that the nozzle assembly 110 does not have to be directly physically connected—i.e., fastened thereon—to the support and control module 102 or the herbicide and mixing module 108. One or more line(s) can connect the herbicide and mixing module 108 or its mixers and/or valves and pumps to the nozzle assembly. A monitoring camera 123 (or a plurality of monitoring cameras) in the vicinity of or above the nozzle assembly can permit the operating personnel in the support and control module 102 to visually monitor the spraying procedure.

The nozzle assembly 110 comprises a first set of nozzles (not shown directly)—for example, designed for spraying herbicides between the rails—and at least one fluid connection 120 to selected ones of the valves and mixers 106 of the herbicide and mixing module 108. A second set of nozzles can be active outside the rails.

All modules of the modular system, i.e., the support and control module 102, the herbicide and mixing module 108, and the nozzle assembly 110, are each individually reversibly fixable on a carrier element 118. The carrier element 118 can consist of one or more carrier cars (not shown).

Figure 2:
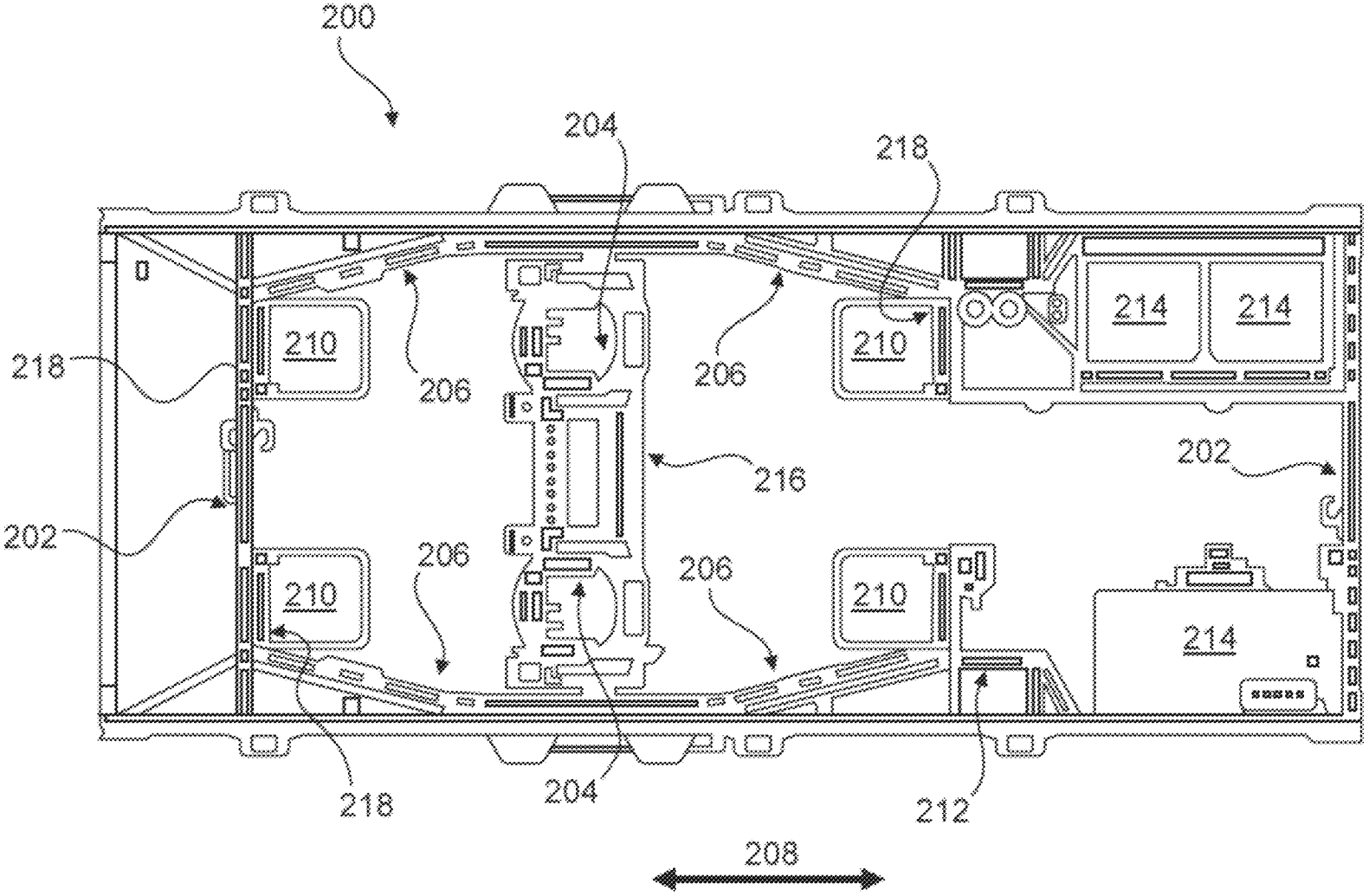
FIG. 2 shows an example of a top view of the support and control module with removed roof, according to some embodiments.

FIG. 2 illustrates an example of a top view 200 of the support and control module 102 having removed roof. Personnel can enter the support and control module 102 via the doors 202. One or two workspaces for operating personnel are located inside the support and control module 102. The respective seats 204 may be rotated at the position around a vertical axis, so that the respective operator can look out of the support and control module 102 in one of the possible travel directions (illustrated by the double arrow 208) through one of the windows 206. The respective operator can engage via a control panel at his seat 204 directly in the function of the control unit 212, which generates the signals for the herbicide and mixing module 108.

To monitor the function of the control unit 212, the function of the nozzle assembly, and the function of the herbicide and mixing module, at least one monitor 218 is located in the field of view of the operator. Additional worktables 210 are also shown directly in front of these monitors 218. Moreover, the support and control module 102 can contain further equipment 214. A passage 216 is provided between the two seats 204.

In the top view shown in FIG. 2, the hexagonal basic shape of the cabin can also be seen, in which a pair of windows 206 (right/left) is inclined in relation to each one of the possible movement directions 208.

Figure 3:
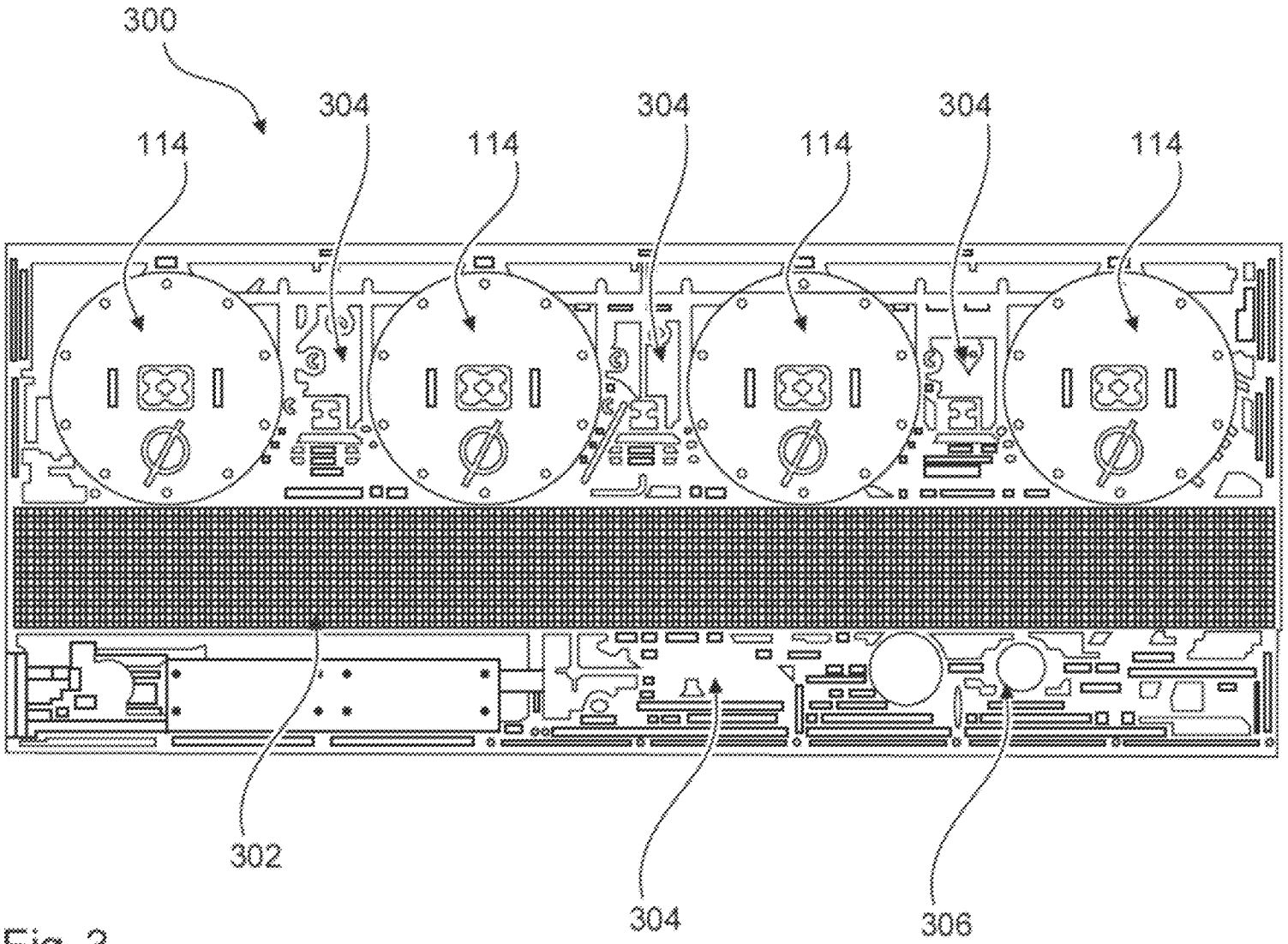
FIG. 3 shows an exemplary embodiment of the herbicide and mixing module in a top view with removed roof, according to some embodiments.

FIG. 3 shows an exemplary embodiment of the herbicide and mixing module 108 in a top view 300 with removed roof. The plurality of containers 114 for accommodating different (or also identical) herbicides can be seen clearly, of which four are shown here by way of example. A catwalk 302 connects a left entry side to a right entry side of the herbicide and mixing module 108. A plurality of lines 304, valves and mixers 304, pumps 306 (as an example), and other types of control units (not shown in detail) enables mixing of various herbicide mixtures, for example, weed-specific herbicide mixtures. The herbicide and mixing module 108 is typically located in a housing in the form of a 20-foot standard container, for example, according to ISO 668:2013-08.

Figure 4:
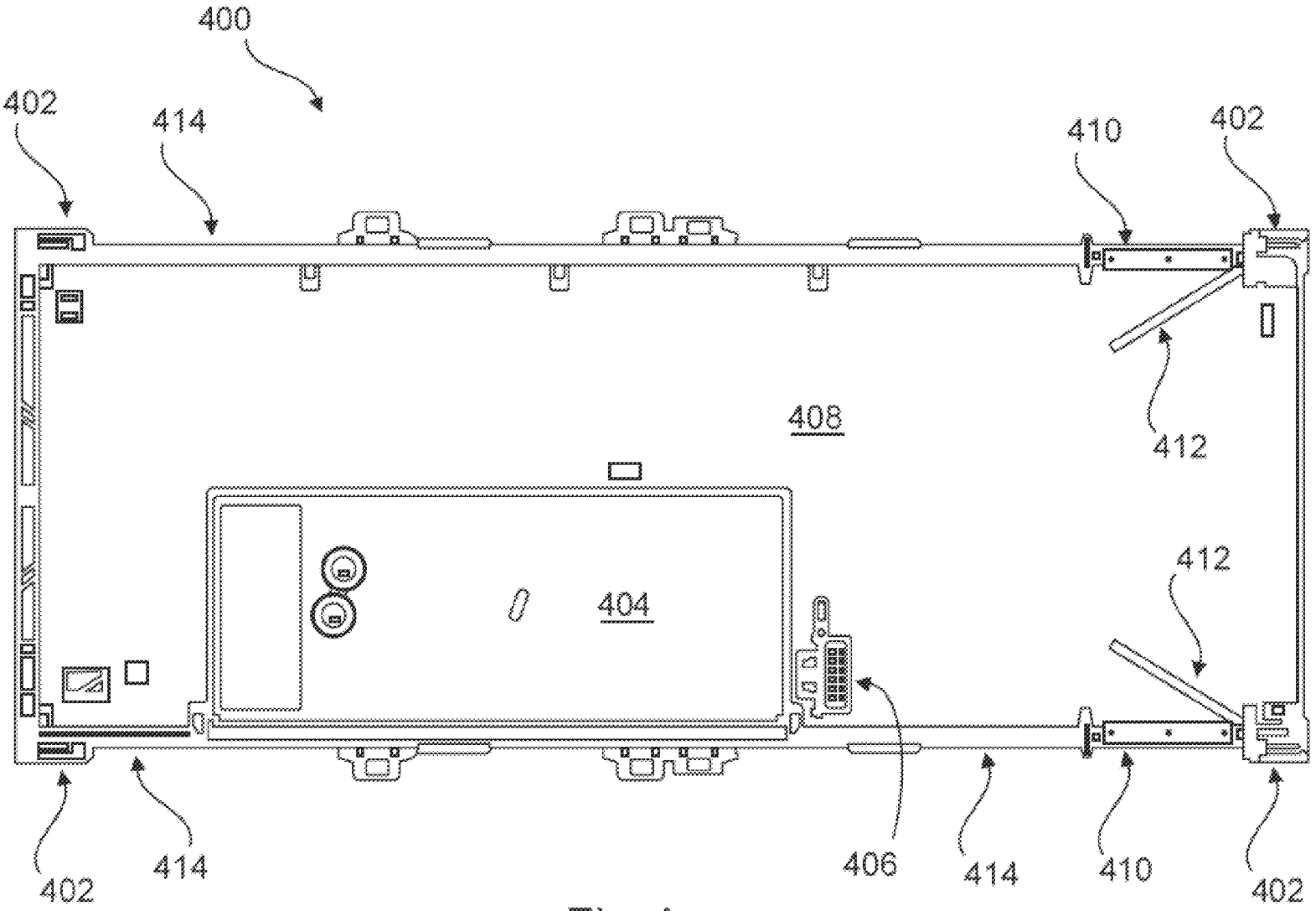
FIG. 4 shows an exemplary embodiment of a top view of the energy module, according to some embodiments.

FIG. 4 shows an exemplary embodiment of a top view of the energy module 400. The energy module 400 consists of an actual power generating block 404, in which an internal combustion engine can generate power with the aid of a generator. The power generating block 404 can be externally controlled via an operating terminal 406. A tank for the fuel can be filled from the top.

The power generating block 404 is installed on a platform, which can assume the footprint, for example, of a 20-foot standard container. Fastening points 402 for fastening on a carrier car can also be seen on this module 400. A lateral grating 414 protects the operating personnel from falling down from the platform 408. The platform 408 is reachable via a respective ladder 410. This ladder can be blocked by respective pivotable doors 412. A grating does not have to be provided on the respective left and right sides of the energy module 400. Rather, the other modules—the support and control module and the herbicide and mixing module—can be reached via these ends of the energy module.

Figure 5:
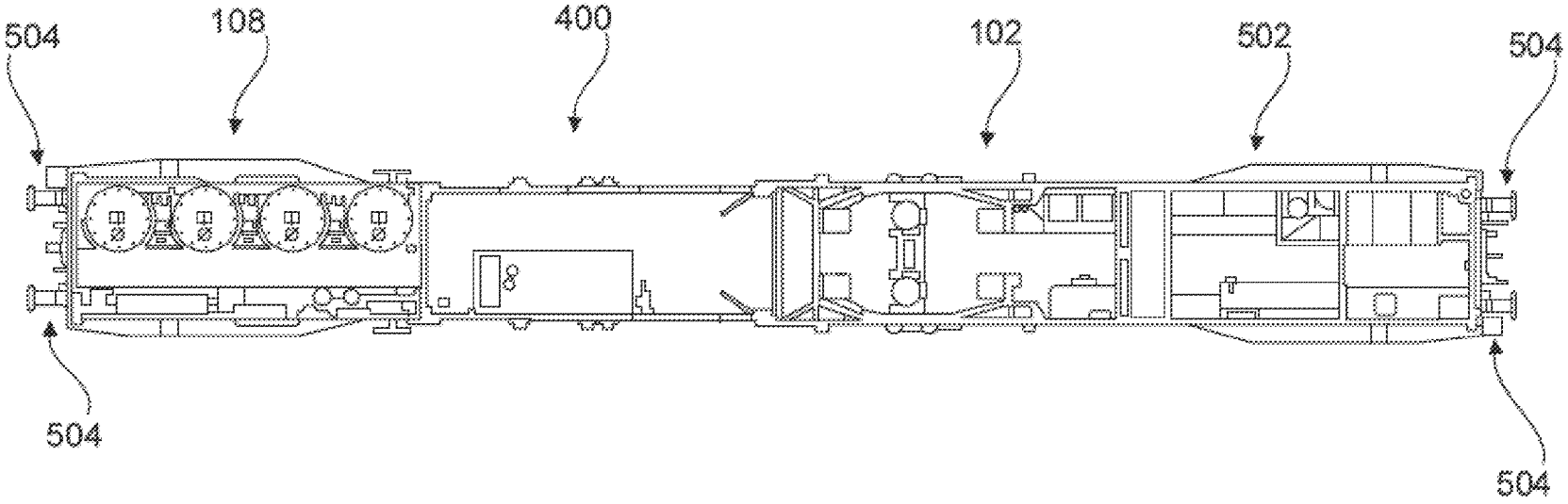
FIG. 5 shows the individual modules in conjunction, according to some embodiments.

FIG. 5 shows multiple modules in conjunction. The herbicide and mixing module 108 is located on the very left, followed by the energy module 400, the support and control module 102, and an additional residence module 502. It can be seen from the bumpers 504 that all modules are illustrated adjacent to one another on a carrier car.

Figure 6:
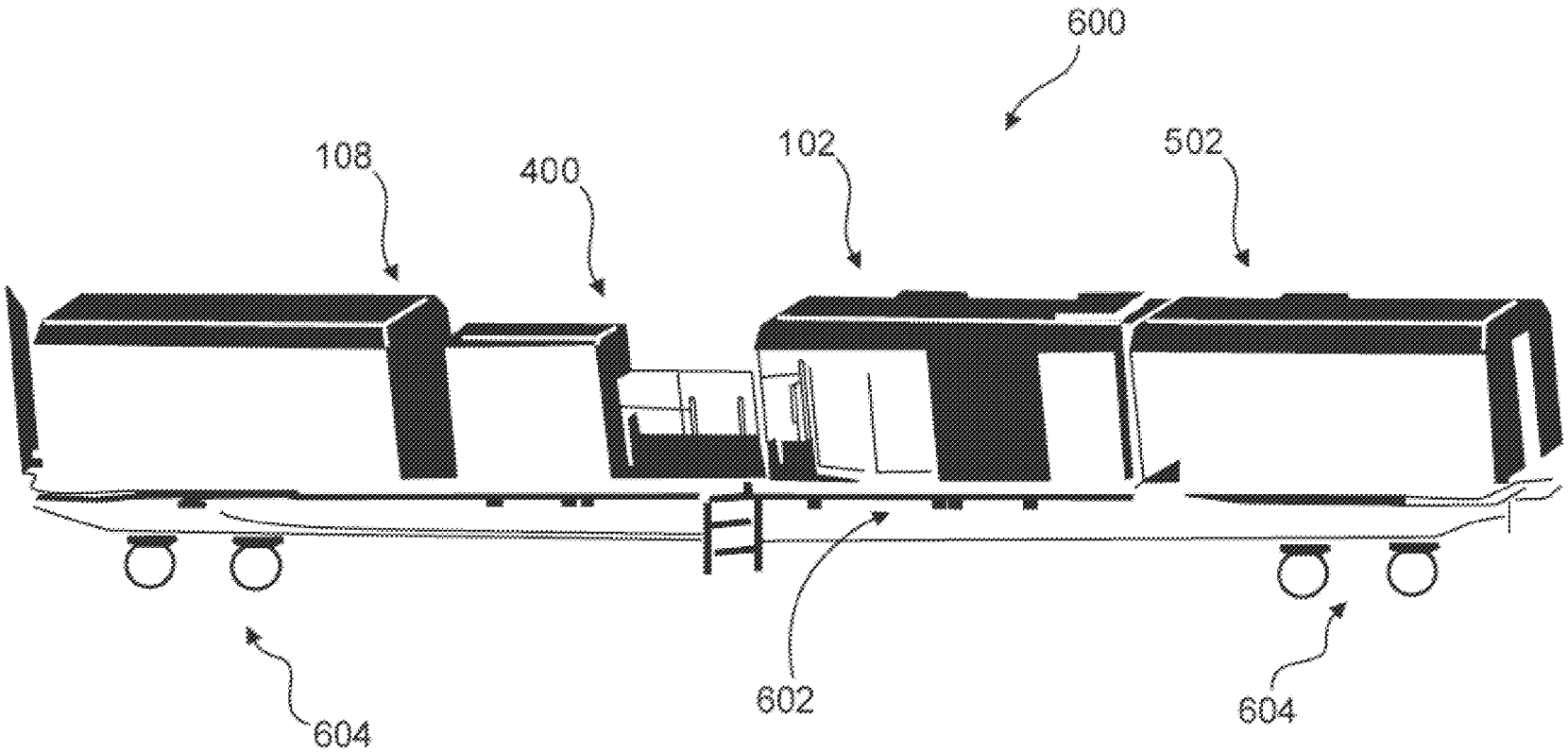
FIG. 6 shows an example of a perspective view of the individual modules in context, according to some embodiments.

FIG. 6 shows an example of a perspective view 600 of the multiple modules: the herbicide and mixing module 108, the energy module 400, the support and control module 102, and the residence module 502. All modules are recognizably shown on a carrier car 602 having two double-axle trucks 604. The illustrated sequence of the individual modules has been shown to be practical. The residence module 502 is located farthest away from the herbicide and mixing module 108, so that even in case of a malfunction of the herbicide and mixing module 108 (for example, uncontrolled herbicide escape), the personnel located on board are protected solely by the distance.

The energy module 400 is located between the herbicide and mixing module 108 and the support and control module 102 and can supply both modules with power well. The platform of the energy module 400 is reachable well both from the mixing module 108 and also from the support and control module 102.

Figure 7:
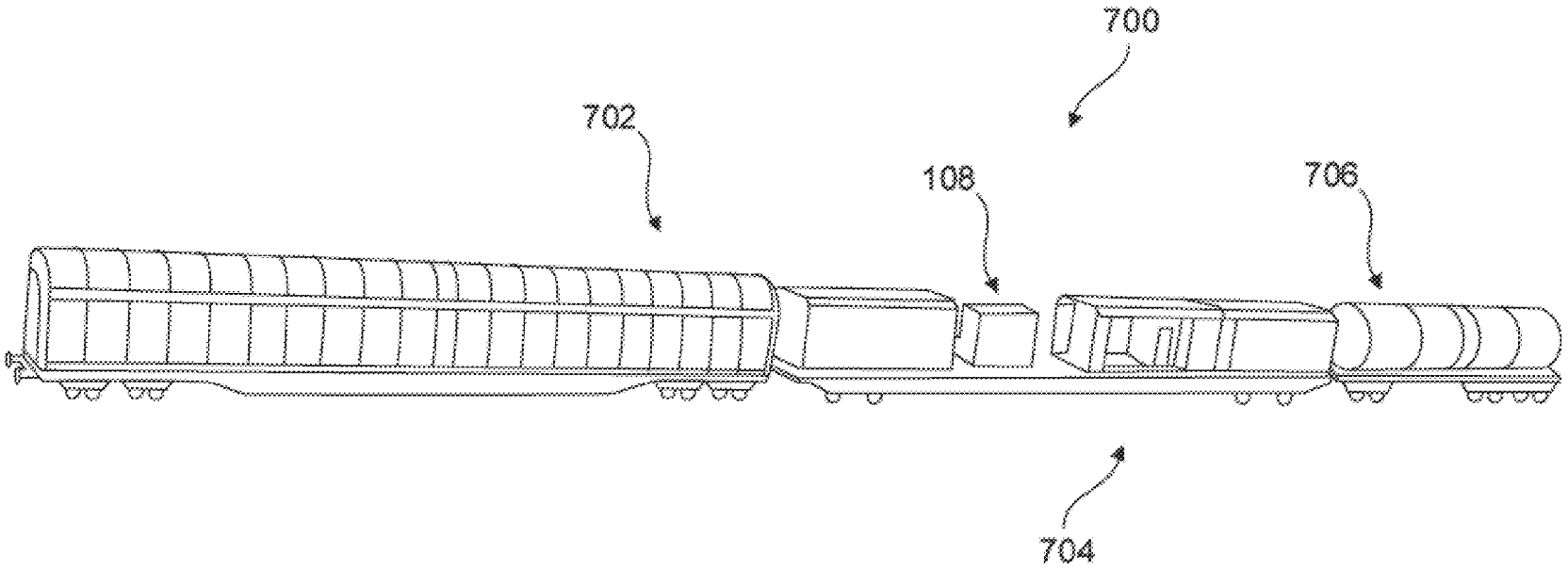
FIG. 7 shows an example of a perspective view of a train having the modular system for weed control, according to some embodiments.

FIG. 7 shows an example of a perspective view of a train 700 consisting of a supply car 702, the carrier car 704 having the complete modular system for weed control, and a tank car 706, using which water can be transported, which can be made available to the mixing module 108 via hoses. The supply car 702 can be used for the storage and transportation of various supply materials for the train; in particular, in this manner various herbicides can be kept ready directly and in larger quantities. The supply of herbicides is thus not restricted to the capacity of the containers in the mixing module 108. A locomotive can be provided at the beginning or at the end of the train 700. The orientation—i.e., the exit of the herbicides out of the nozzle assembly —is to be adapted in accordance with the travel direction of the train. It is not necessary to rearrange the modules of the modular system for weed control for another travel direction.

Figure 8:
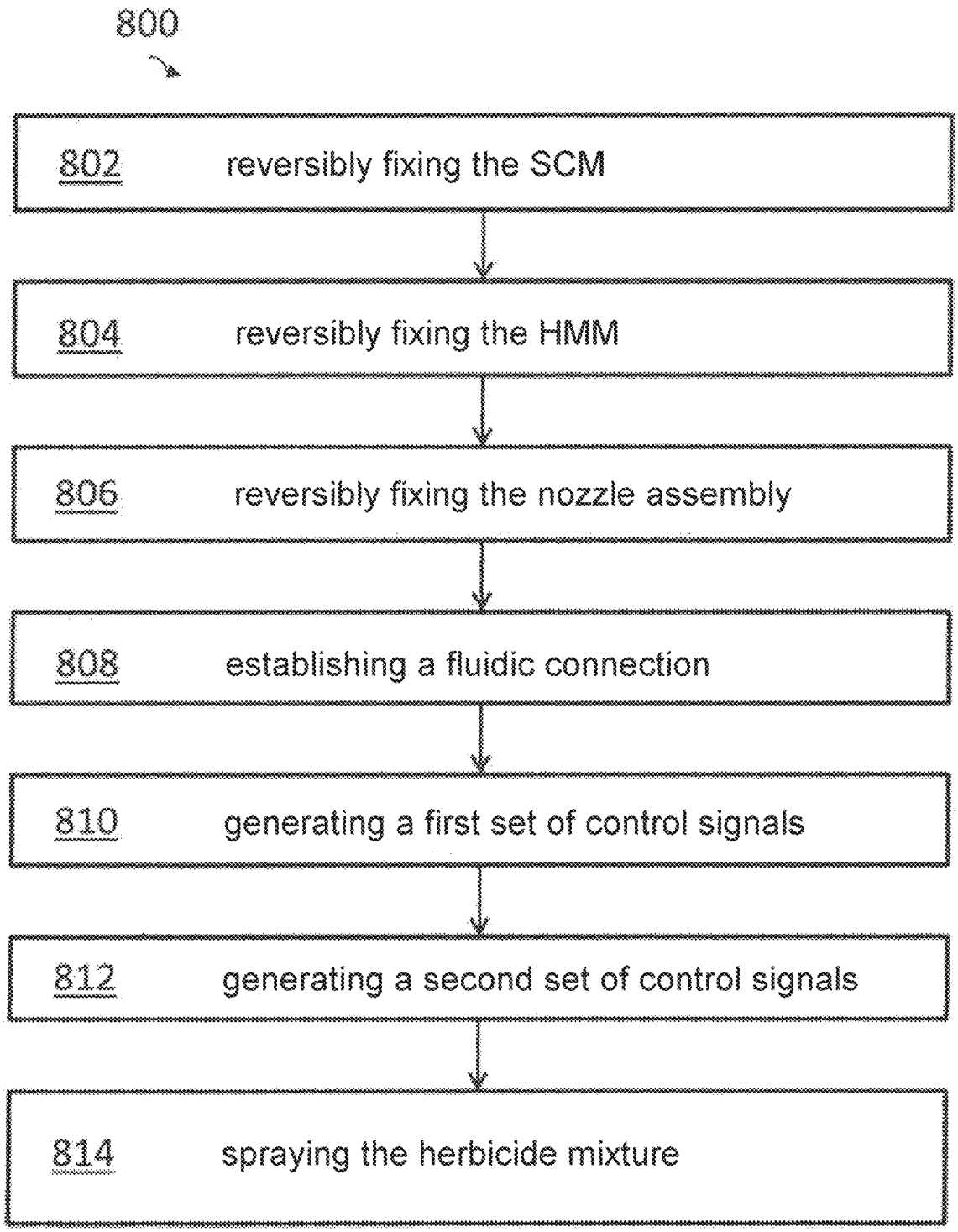
FIG. 8 shows the system for controlling weeds in a track bed by means of the modular system, according to some embodiments.

FIG. 8 shows the method 800 for controlling weeds in a track bed. The method comprises the following: reversible fixing 802 of a support and control module (SCM) on a carrier element, for example, reversible fixing 804 of a herbicide and mixing module (HMM) on the carrier element, and reversible fixing 806 of a nozzle assembly on the carrier element.

In this case, the nozzle assembly is positioned spatially independently of each of both the support and control module and also the herbicide and mixing module.

The method 800 furthermore comprises: establishing 808 a fluid connection between the herbicide and mixing module and the nozzle assembly, generating 810 a first set of control signals for controlling valves and mixers in the herbicide and mixing module for mixing a weed-specific herbicide mixture by means of a control unit of the support and control module, and generating 812 a second set of control signals for controlling valves of a nozzle assembly by means of the control unit of the support and control module, and selective spraying 814 of the weed-specific herbicide mixture via nozzles of the nozzle assembly onto railways. In this case, the herbicide and mixing module comprises at least the following: a plurality of containers for accommodating different herbicides, which can selectively have a selective fluidic connection to the valves and mixers, a water fitting, which selectively has a selective fluidic connection to the valves and mixers, and terminal elements, via which electrical signal connections can be established to terminal elements of the control unit, so that the first control signals generated in the support and control module can be relayed to the valves and mixers of the herbicide and mixing module.

The description of the various embodiments of the present invention was used for illustration purposes. It is not intended to restrict the scope of the inventive concept. Further modifications and variations will be apparent to a person skilled in the art without deviating from the core of the present invention.

The invention claimed is:

1. A modular system for weed control for a rail vehicle, comprising:

a support and control module comprising:

a control unit configured to:

generate a first set of control signals for controlling valves and mixers in a separate herbicide and mixing module for mixing an herbicide mixture; and generate a second set of control signals for controlling valves of a nozzle assembly; and a control station for manually monitoring and checking the control unit, the herbicide and mixing module, and the nozzle assembly, wherein the herbicide and mixing module comprises:

a plurality of containers for accommodating different herbicides, wherein the plurality of containers has a selective fluidic connection to the valves and mixers, a water fitting comprising a selective fluidic connection to the valves and mixers, and terminal elements, via which electrical signal connections are established to terminal elements of the control unit, so that the first control signals generated in the support and control module can be conducted to the valves and mixers of the herbicide and mixing module, and wherein the nozzle assembly, which is spatially independent of each of both the support and control module and the herbicide and mixing module, comprises:

a first set of nozzles for spraying herbicides, and a fluidic connection to selected ones of the valves and mixers of the herbicide and mixing module, wherein the support and control module, the herbicide and mixing module, and the nozzle assembly are each individually reversibly fixable on a carrier element, and wherein the support and control module and the herbicide and mixing module are embodied in container construction.

2. The modular system of claim 1, further comprising a camera module configured to generate a weed signal in reaction to a detection of a weed, wherein the control unit of the support and control module is configured to receive the weed signal, and wherein the generation of the first set of control signals and the generation of the second set of control signals is controllable by the received weed signal.

3. The modular system of claim 1, wherein the generation of the first set of control signals and the generation of the second set of control signals are manually triggered.

4. The modular system of claim 1, wherein the generation of the first set of control signals and the generation of the second set of control signals are triggered by a weed map and a position of the nozzle assembly determined by a received GPS signal.

5. The modular system of claim 1, further comprising:

an energy module on a platform in container construction, wherein the energy module is electrically connectable to each of the support and control module and the herbicide and mixing module, and wherein the energy module is reversibly fixable on the carrier element.

6. The modular system of claim 1, further comprising:

a residence module in container construction comprising a passage to the support and control module, wherein the residence module is reversibly fixable on the carrier element.

7. The modular system of claim 1, wherein the carrier element is a carrier car for a rail usage.

8. The modular system of claim 7, wherein the carrier car is a standard 80-foot carrier car.

9. The modular system of claim 7, wherein the carrier car comprises multiple carrier cars coupled to one another.

10. The modular system of claim 1, wherein at least one module selected from the group consisting of the support and control module and the herbicide and mixing module corresponds to the size of a 20-foot container.

11. The modular system of claim 1, further comprising a second set of nozzles on the nozzle assembly, wherein the first set of nozzles is arranged below the carrier element, so that the first set of nozzles of the nozzle assembly is usable for weed control in a track bed, and wherein one half of the second set of nozzles is arranged at each lateral end of the nozzle assembly.

12. The modular system of claim 1, wherein the support and control module comprises a window inclined in a travel direction of the rail vehicle, wherein a first vertical end of the window ends at an outer exterior side of the support and control module, and wherein an opposing, second vertical end of the window is offset in the direction of a middle of the support and control module in the longitudinal direction of the support and control module.

13. The modular system of claim 1, wherein the support and control module comprises on its outer side a monitoring camera at the height of the nozzle assembly for monitoring a spraying procedure.

14. The modular system of claim 1, wherein the nozzle assembly is reversibly fastened on the carrier element below the support and control module.

15. A spraying train for weed control on railways, comprising:

one or more carrier cars comprising:

a support and control module comprising:

a control unit configured to:

generate a first set of control signals for controlling valves and mixers in a separate herbicide and mixing module for mixing an herbicide mixture; and generate a second set of control signals for controlling valves of a nozzle assembly; and a control station for manually monitoring and checking the control unit, the herbicide and mixing module, and the nozzle assembly, wherein the herbicide and mixing module comprises:

a plurality of containers for accommodating different herbicides, wherein the plurality of containers has a selective fluidic connection to the valves and mixers, a water fitting comprising a selective fluidic connection to the valves and mixers, and terminal elements, via which electrical signal connections are established to terminal elements of the control unit, so that the first control signals generated in the support and control module can be conducted to the valves and mixers of the herbicide and mixing module, and wherein the nozzle assembly, which is spatially independent of each of both the support and control module and the herbicide and mixing module, comprises:

a first set of nozzles for spraying herbicides, and a fluidic connection to selected ones of the valves and mixers of the herbicide and mixing module, wherein the support and control module, the herbicide and mixing module, and the nozzle assembly are each individually reversibly fixable on the one or more carrier cars, and wherein the support and control module and the herbicide and mixing module are embodied in container construction;

a tank car for accommodating water; and a freight car.

16. The spraying train of claim 15, further comprising:

an energy module on a platform in container construction and reversibly fixable on the one or more carrier cars, wherein the energy module is electrically connectable to each of the support and control module and the herbicide and mixing module; and a residence module in container construction comprising a passage to the support and control module, wherein the residence module is reversibly fixable on the one or more carrier cars, wherein the modules are arranged in one of the two possible movement directions of the spraying train in the following sequence: the herbicide and mixing module, the energy module, the support and control module, and the residence module.

17. A method for controlling weeds in a track bed, comprising:

reversibly fixing a support and control module on a carrier element;

reversibly fixing an herbicide and mixing module on the carrier element;

reversibly fixing a nozzle assembly on the carrier element, wherein the nozzle assembly is spatially independent of each of both the support and control module and the herbicide and mixing module, wherein the carrier element comprises one or more carrier cars;

establishing a fluidic connection between the herbicide and mixing module and the nozzle assembly;

generating, by a control unit of the support and control module, a first set of control signals for controlling valves and mixers in the herbicide and mixing module for mixing an herbicide mixture;

generating, by the control unit of the support and control module, a second set of control signals for controlling valves of the nozzle assembly; and selectively spraying the herbicide mixture via nozzles of the nozzle assembly onto railways, wherein the herbicide and mixing module comprises:

a plurality of containers for accommodating different herbicides, wherein the plurality of containers comprises a selective fluidic connection to the valves and mixers, a water fitting comprising a selective fluidic connection to the valves and mixers, and terminal elements, via which electrical signal connections are established to terminal elements of the control unit, so that the first control signals generated in the support and control module can be conducted to the valves and mixers of the herbicide and mixing module, and wherein the support and control module and the herbicide and mixing module are embodied in container construction, and wherein the support and control module comprises a control station for manually monitoring and checking the control unit, the herbicide and mixing module, and the nozzle assembly.

18. The modular system of claim 5, wherein the energy module corresponds to the size of a 20-foot container.

19. The modular system of claim 6, wherein the residence module corresponds to the size of a 20-foot container.

* * * * *